US006451219B1

(12) United States Patent
Iyengar et al.

(10) Patent No.: US 6,451,219 B1
(45) Date of Patent: Sep. 17, 2002

(54) USE OF HIGH SURFACE AREA UNTREATED FUMED SILICA IN MR FLUID FORMULATION

(75) Inventors: Vardarajan R. Iyengar, Beavercreek, OH (US); Robert T. Foister, Rochester Hills, MI (US)

(73) Assignee: Delphi Technologies, Inc., Troy, MI (US)

( * ) Notice: Subject to any disclaimer, the term of this patent is extended or adjusted under 35 U.S.C. 154(b) by 3 days.

(21) Appl. No.: 09/723,925

(22) Filed: Nov. 28, 2000

(51) Int. Cl.[7] ..... H01F 1/44
(52) U.S. Cl. ..... 252/42.52
(58) Field of Search ..... 252/42.52

(56) References Cited

U.S. PATENT DOCUMENTS

| | | | | |
|---|---|---|---|---|
| 4,957,644 A | | 9/1990 | Price et al. | 252/62.52 |
| 4,992,190 A | | 2/1991 | Shtarkman | 252/62.52 |
| 5,354,488 A | | 10/1994 | Shtarkman et al. | 252/62.56 |
| 5,382,373 A | | 1/1995 | Carlson et al. | 252/62.55 |
| 5,578,238 A | | 11/1996 | Weiss et al. | 252/62.52 |
| 5,599,474 A | | 2/1997 | Weiss et al. | 252/62.52 |
| 5,645,752 A | | 7/1997 | Weiss et al. | 252/62.54 |
| 5,667,715 A | * | 9/1997 | Foister | 252/62.52 |
| 5,906,767 A | | 5/1999 | Karol et al. | 252/62.52 |
| 5,985,168 A | | 11/1999 | Phule | 252/62.52 |
| 5,989,447 A | * | 11/1999 | Podszun et al. | 252/62.52 |
| 6,027,664 A | | 2/2000 | Weiss et al. | 252/62.52 |
| 6,132,633 A | | 10/2000 | Carlson | 252/62.52 |
| 2001/0032961 A1 | * | 10/2001 | Iyengar | 252/62.52 |
| 2001/0045540 A1 | * | 11/2001 | Iyengar | 252/62.52 |

* cited by examiner

*Primary Examiner*—C. Melissa Koslow
(74) *Attorney, Agent, or Firm*—Scott A. McBain

(57) ABSTRACT

A magnetorheological fluid formulation exhibiting high yield stress at high surfactant concentrations. The formulation has a strong network formation due to incorporation of a high surface area untreated fumed silica as a thixotropic agent. This untreated fumed silica has a surface area of at least about 250 $m^2/g$, which enables a surfactant concentration in the formulation in an amount up to about 35% by weight relative to the weight of the fumed silica.

32 Claims, 1 Drawing Sheet

USE OF HIGH SURFACE AREA UNTREATED FUMED SILICA IN MR FLUID FORMULATION

FIELD OF THE INVENTION

This invention relates to magnetorheological fluids.

BACKGROUND OF THE INVENTION

Magnetorheological (MR) fluids are substances that exhibit an ability to change their flow characteristics by several orders of magnitude and in times on the order of milliseconds under the influence of an applied magnetic field. An analogous class of fluids are the electrorheological (ER) fluids which exhibit a like ability to change their flow or Theological characteristics under the influence of an applied electric field. In both instances, these induced rheological changes are completely reversible. The utility of these materials is that suitably configured electromechanical actuators which use magnetorheological or electrorheological fluids can act as a rapidly responding active interface between computer-based sensing or controls and a desired mechanical output. With respect to automotive applications, such materials are seen as a useful working media in shock absorbers, for controllable suspension systems, vibration dampers in controllable powertrain and engine mounts and in numerous electronically controlled force/torque transfer (clutch) devices.

MR fluids are noncolloidal suspensions of finely divided (typically one to 100 micron diameter) low coercivity, magnetizable solids such as iron, nickel, cobalt, and their magnetic alloys dispersed in a base carrier liquid such as a mineral oil, synthetic hydrocarbon, water, silicone oil, esterified fatty acid or other suitable organic liquid. MR fluids have an acceptably low viscosity in the absence of a magnetic field but display large increases in their dynamic yield stress when they are subjected to a magnetic field of, e.g., about one Tesla. At the present state of development, MR fluids appear to offer significant advantages over ER fluids, particularly for automotive applications, because the MR fluids are less sensitive to common contaminants found in such environments, and they display greater differences in rheological properties in the presence of a modest applied field.

Since MR fluids contain noncolloidal solid particles which are often seven to eight times more dense than the liquid phase in which they are suspended, suitable dispersions of the particles in the liquid phase must be prepared so that the particles do not settle appreciably upon standing nor do they irreversibly coagulate to form aggregates. Examples of magnetorheological fluids are illustrated, for example, in U.S. Pat. No. 4,957,644 issued Sep. 18, 1990, entitled "Magnetically Controllable Couplings Containing Ferrofluids"; U.S. Pat. No. 4,992,190 issued Feb. 12, 1991, entitled "Fluid Responsive to a Magnetic Field"; U.S. Pat. No. 5,167,850 issued Dec. 1, 1992, entitled "Fluid Responsive to a Magnetic Field"; U.S. Pat. No. 5,354,488 issued Oct. 11, 1994, entitled "Fluid Responsive to a Magnetic Field"; and U.S. Pat. No. 5,382,373 issued Jan. 17, 1995, entitled "Magnetorheological Particles Based on Alloy Particles".

As suggested in the above patents and elsewhere, a typical MR fluid in the absence of a magnetic field has a readily measurable viscosity that is a function of its vehicle and particle composition, particle size, the particle loading, temperature and the like. However, in the presence of an applied magnetic field, the suspended particles appear to align or cluster and the fluid drastically thickens or gels. Its effective viscosity then is very high and a larger force, termed a yield stress, is required to promote flow in the fluid.

The magnetizable particles are kept in suspension by dispersing a thixotropic agent, such as fumed or precipitated silica. Silicas stabilize the MR fluid by forming a network through hydrogen bonding between silica particles. This network breaks down under shear and reforms upon cessation of shear to keep the magnetizable particles suspended while exhibiting low viscosity under shear. Precipitated silica typically has a large particle size and low surface area due to its method of formation, whereas fumed silicas are typically smaller in size with larger surface area. Fumed silicas, when used, are typically surface treated. Both precipitated silicas and treated fumed silicas, however, often exhibit poor network formation, and consequently low yield stresses in the MR fluid during operation.

MR fluids may additionally contain surfactants to prevent coagulation of the magnetizable particles. For example, the magnetizable particles may be coated with the surfactant. The surfactant is typically used in amounts less than 10% by weight relative to the weight of the silica. This typically translates to a concentration of less than 0.1% by weight of the fully formulated MR fluid. As the concentration of surfactant increases, the yield stress decreases. Yield stress is an indication of the strength of the silica network. While higher amounts of surfactant would be desirable, the amount of surfactant that may currently be used is limited due to its interference with the function of the thixotropic agent.

There is thus a need to develop a stable non-coagulating suspension having a strong network formation in the presence of high surfactant concentrations.

SUMMARY OF THE INVENTION

The present invention provides a magnetorheological fluid formulation that is a non-coagulating suspension having a high yield stress with low susceptibility to free surfactant at surfactant concentrations up to about 35% by weight relative to the weight of fumed silica therein. The fluid formulation comprises a suspension of magnetizable particles dispersed in a mixture of a liquid vehicle, a surfactant and a thixotropic agent. The thixotropic agent is an untreated fumed silica having a surface area of at least about 250 $m^2/g$, which provides a large number of bonding sites for strong network formation.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION

Figure 1:
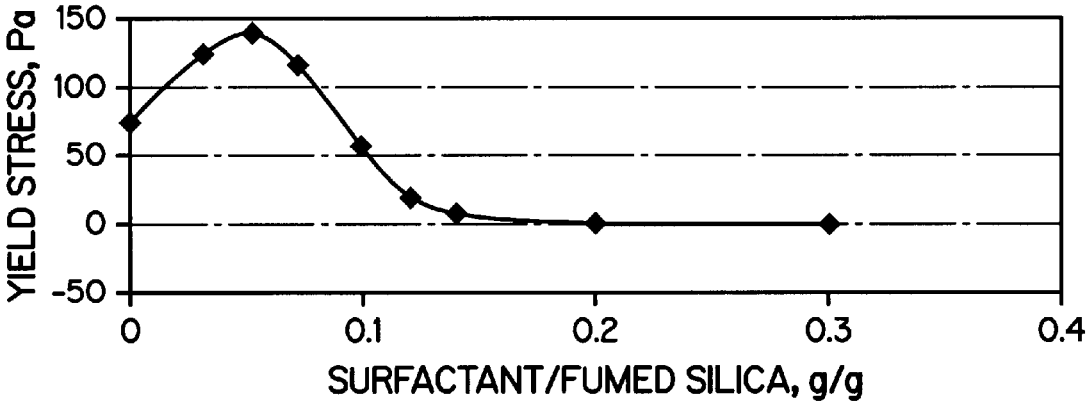
FIG. 1 is a graphical depiction of the variation in yield stress with increasing levels of surfactant concentration, as expressed by weight ratio of surfactant to fumed silica, using an untreated fumed silica with a surface area of 200 $m^2/g$ in accordance with the prior art.

The present invention provides a MR fluid having a high yield stress at surfactant concentrations up to about 35% by weight relative to the weight of a fumed silica thixotropic agent. To this end, and in accordance with the present invention, the MR fluid formulation comprises magnetizable particles suspended in a liquid carrier or vehicle, an untreated fumed silica having a surface area of at least about 250 $m^2/g$, and up to 35% by weight surfactant relative to the weight of the fumed silica. The MR fluid formulation of the present invention is particularly applicable at application temperatures below 100° C. and shear rates less than 10,000 $seconds^{-1}$.

The magnetizable particles are suspended in the MR fluid by the dispersed silica which forms a network through hydrogen bonding. For this hydrogen bonding to occur, there must be hydrogen bonding sites available at the surface of each silica particle for bonding to adjacent particles. In the case of precipitated and fumed silica, it is theorized that the smaller surface area of precipitated silica provides fewer hydrogen bonding sites for network formation than the larger surface area of fumed silica. However, fumed silicas are typically surface treated. A common treatment of fumed silica is a polymer coating, such as a silane treatment. When treated fumed silicas are used as the dispersing or thixotropic agent, the surface treatment may take up hydrogen bonding sites on the silica particle surfaces, making them unavailable for network formation. In treated fumed silica, network formation is primarily achieved through interaction of the coated polymer chains. However, this network tends to be weaker than the hydrogen bonding network. Similarly, the magnetizable particles coated with surfactant may contain a small amount of free, unreacted surfactant, and this surfactant can, in certain amounts, severely inhibit the effectiveness of the fumed silica network by taking up hydrogen bonding sites, making them unavailable for network formation. However, the surfactant is incapable of forming even a weak polymer chain type network as in the case of the treated silica.

The present invention addresses the problem of poor network formation by utilizing an untreated fumed silica having a high surface area of at least about 250 $m^2/g$, for example about 275–410 $m^2/g$. This high surface area fumed silica has a large number of hydrogen bonding sites available for network formation with none of the sites being unavailable due to surface polymer treatment. According to the present invention, a higher amount of surfactant can then be used in the MR fluid formation, because even if some of the sites are taken up by free unreacted surfactant, there are still plenty of sites left to serve the bonding function.

The present invention can be demonstrated by comparison of an MR base fluid formulation of the prior art using a low surface area untreated fumed silica and an MR base fluid formulation of the present invention using a high surface area untreated fumed silica. In the following demonstration, the base formulations include the liquid vehicle, surfactant and untreated fumed silica without the addition of the magnetizable particles. The prior art base formulation uses an untreated fumed silica having a surface area of 200 $m^2/g$. The MR base fluid formulation of the present invention uses an untreated fumed silica having a surface area of 380 $m^2/g$.

FIG. 1 depicts the variation of the yield stress with increasing concentration of an ethoxylated tallow alkyl amine surfactant (Ethomene T-15, manufactured by Akzo Chemical Co., Inc.) in a prior art base fluid formulation. It can be observed that the yield stress initially increases and reaches a maximum at 5% by weight of surfactant to 200 $m^2/g$ fumed silica. The initial increase in yield stress is due to a "bridging" phenomenon, which is well known in the art. At a surfactant concentration of about 12%, the yield stress has decreased significantly to an unacceptably low value. At a surfactant to fumed silica ratio of 15%, the yield stress is nearly zero. From FIG. 1, it is apparent that this particular fumed silica having a surface area of only 200 $m^2/g$ is susceptible to a large concentration of free surfactant, which interferes with network formation. The 12% weight ratio of surfactant to fumed silica translates to a surfactant concentration of only about 0.12% by weight in a fully formulated MR fluid. MR fluids formulated with this particular low surface area fumed silica would be susceptible to small amounts of free surfactant, and thus the surfactant concentration should be limited to less than 10% by weight relative to the weight of the fumed silica.

Figure 2:
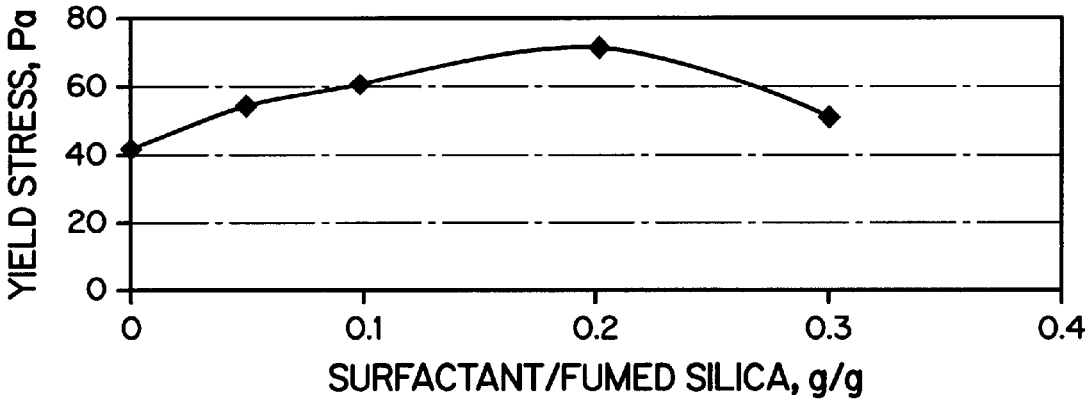
FIG. 2 is a graphical depiction of the variation in yield stress with increasing levels of surfactant concentration, as expressed by weight ratio of surfactant to fumed silica, using an untreated fumed silica with a surface area of 380 $m^2/g$ in accordance with the present invention.

FIG. 2 shows the variation in the yield stress with increasing levels of surfactant concentration, as in FIG. 1, but with a base fluid formulation of the present invention. It can be observed that the yield stress is not significantly affected at surfactant concentrations up to 30% by weight relative to the weight of the fumed silica. Thus, strong network formation occurs without significant interference from free surfactant. The 30% weight ratio of surfactant to 380 $m^2/g$ fumed silica translates to a surfactant concentration of 0.3% by weight in a fully formulated MR fluid. MR fluids formulated with the higher surface area fumed silica will be less susceptible to free surfactant. Given that the fumed silica network will be more resistant to the presence of free surfactant, improved performance in the MR fluid will be exhibited at high surfactant concentrations.

By way of example, the magnetizable particles suitable for use in the fluids are magnetizable ferromagnetic, low coercivity (i.e., little or no residual magnetism when the magnetic field is removed), finely divided particles of iron, nickel, cobalt, iron-nickel alloys, iron-cobalt alloys, iron-cobalt-nickel alloys, nickel-cobalt alloys, iron-silicon alloys and the like which are spherical or nearly spherical in shape and have a diameter in the range of about 1 to 100 microns. Because the particles are employed in noncolloidal suspensions, it is preferred that the particles be at the small end of the suitable range, preferably in the range of 1 to 10 microns in nominal diameter or particle size. The magnetizable particles may also have a bimodal size distribution, such as that described in U.S. Pat. No. 5,657,715, issued Sep. 16, 1997, entitled "Magnetorheological Fluids" incorporated by reference herein in its entirety. For example, the magnetizable particles may be a mixture of spherical particles in the range of 1 to 100 microns in diameter with two distinct particle size members present, one a relatively large particle size that is 5 to 10 times the mean diameter of the relatively small particle size component. In a further example, the magnetizable particles have a bimodal size distribution, with a first group of particles having a mean diameter greater than 7 $\mu$m and a second group of particles having a mean diameter less than 3 $\mu$m.

The liquid or carrier phase may be any material which can be used to suspend the particles but does not otherwise react with the MR particles. Such liquids include but are not limited to water, hydrocarbon oils, other mineral oils, esters of fatty acids, other organic liquids, polydimethylsiloxanes and the like. Particularly suitable and inexpensive liquids are relatively low molecular weight hydrocarbon polymer liquids as well as suitable esters of fatty acids that are liquid at the operating temperature of the intended MR device and have suitable viscosities for the off condition as well as for suspension of the MR particles. Polyalphaolefin (PAO) is a suitable base liquid for many MR applications in accordance with this invention. However, the polyalphaolefin does not have suitable lubricant properties for some applications.

Therefore, PAO may be used in mixture with known lubricant liquids such as liquid alkyl ester-type fatty acids. Alternatively, such esterified fatty acids or other lubricant-type liquids may be employed with no PAO present. Examples of other suitable MR liquids include dioctyl sebacate and alkyl esters of tall oil type fatty acids. Methyl esters and 2-ethyl hexyl esters have been used. Saturated fatty acids with various esters including polyol esters, glycol esters and butyl and 2-ethyl hexyl esters have been tried and found suitable for use with the bimodal magnetic particles described in U.S. Pat. No. 5,667,715. Mineral oils and silicone liquids, e.g., Dow Chemical 200 Silicone Fluids, have also been used with bimodal particles as MR liquids.

The MR fluid formulation of the present invention further includes the surfactant to reduce the tendency for coagulation of the particles during utilization of MR fluids. Such surfactants include known surfactants or dispersing agents such as ferrous oleate and naphthenate, metallic soaps (e.g., aluminum tristearate and distearate), alkaline soaps (e.g., lithium and sodium stearate), sulfonate, phosphate esters, stearic acid, glycerol monooleate, sorbitan sesquioleate, stearates, laurates, fatty acids, fatty alcohols, and other surface active agents. In addition, the surfactant may be comprised of stearic stabilizing molecules, including fluoroaliphatic polymeric esters and titanate, aluminate or zirconate coupling agents. Also by way of example, the surfactant may be ethoxylated tallow alkyl amine, ethoxylated coco alkyl amine, ethoxylated oleyl amine, ethoxylated soya alkyl amine, ethoxylated octadecyl amine or an ethoxylated diamine such as ethoxylated N-tallow-1,3-diamino propane. In accordance with the present invention, the surfactant may be employed in an amount up to 35% by weight relative to the weight of the fumed silica, for example about 10–30% by weight.

In an embodiment of the present invention, the magnetizable particles may be coated with the surfactant. An example of this practice with a bimodal iron particle distribution is as follows. A tallow-amine surfactant (Ethomene T-15, manufactured by Akzo Chemical Company, Inc.) is selected for purposes of this example. The surfactant is first dissolved in PAO liquid vehicle (SHF 21, manufactured by Mobil Chemical Company) with a surfactant concentration in the vehicle equal to about 10–30% by weight of the fumed silica to be used in the formulation. The larger particle size iron powder (R-1470, manufactured by ISP Technologies, Inc.) is then mixed with the surfactant solution for eight hours, after which the mixture is filtered and the surfactant coated iron particles recovered for later use in formulating MR fluids. A treatment of this type with a surfactant on the larger particle size is found to minimize or eliminate coagulation and clumping of iron particles in the MR fluids. The pretreated large particles and nonpretreated small particles are then combined in predetermined desired proportions to form bimodal distributions.

In the preparation, then, of the MR fluids, the liquid vehicle and the untreated fumed silica are mixed under high shear conditions. By way of example, the liquid vehicle and silica may be mixed for approximately 10 minutes. The resultant thixotropic fluid is degassed, for example for 5 to 10 minutes. The untreated fumed silica has a surface area greater than about 250 $m^2/g$, for example about 275–410 $m^2/g$. Suitable commercially available untreated fumed silicas include EH-5 having a surface area of 380±30 $m^2/g$, HS-5 having a surface area of 325±25 $m^2/g$, and H-5 having a surface area of 300±25 $m^2/g$, each available from Cabot Corporation, Tuscola, Ill. Due to the large surface area of these untreated fumed silicas, an increased number of hydroxyl groups are available on the surface to promote hydrogen bonding between silica particles and added magnetizable particles. The untreated finned silica may be present in the formulation in an amount ranging from about 0.1–5.0% by weight relative to the overall weight of the magnetorheological fluid. For example, the MR fluid formulation may comprise about 0.5–3.0% by weight fumed silica In one embodiment of the present invention, this thixotropic fluid is next pretreated with surfactant. Due to the presence of a greater number of hydroxyl groups on the surface of the untreated fumed silica, high amounts of surfactant may be added to the fluid formulation while still maintaining sufficient hydroxyl groups for bonding between silica particles. For example, the surfactant may be present in amounts up to about 35% by weight relative to the weight of the fumed silica. By way of further example, the surfactant may be present in amounts between about 10% and about 30%. Where the surfactant is present at a concentration of about 30% by weight relative to the weight of the fumed silica, the surfactant concentration in the fully-formulated MR fluid is approximately 0.3% by weight. After the thixotropic fluid is treated with the surfactant, solid magnetic particles are added to the fluid and the final fluid formulation is mixed for an appropriate time, for example 6–8 hours to effect an in situ coating of the magnetizable particles with surfactant. The fluid formulation is then degassed once again before use.

In an alternative embodiment of the present invention for preparing an MR fluid, the untreated fumed silica is mixed under high shear conditions in the liquid vehicle and then degassed, as described above. Then, solid magnetizable particles pretreated with surfactant are added to the thixotropic fluid and the final fluid mixed and degassed before use. Thus, the coating of magnetizable particles with surfactant is accomplished ex situ, rather than treating the thixotropic fluid and coating the particles in situ.

In use, the MR fluids of the present invention are non-coagulating due to high surfactant concentrations, yet exhibit consistently high yield stresses at these high concentrations due to use of high surface area untreated fumed silica as a thixotropic agent. The MR fluids of the present invention are particularly suitable in applications having temperatures below 100° C. and shear rates less than 10,000 $seconds^{-1}$.

While the present invention has been illustrated by the description of embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of applicant's general inventive concept.

What is claimed is:

1. A magnetorheological fluid formulation comprising magnetizable particles dispersed in a mixture of a liquid vehicle, a surfactant and a thixotropic agent, wherein the thixotropic agent is untreated fumed silica having a surface area of at least about 250 $m^2/g$, and wherein the surfactant is present in the formulation in an amount between about 10% and about 30% by weight relative to the weight of the fumed silica.

2. The formulation of claim 1, wherein the magnetizable particles are selected from the group consisting of iron, nickel, cobalt and magnetic alloys thereof.

3. The formulation of claim 2, wherein the magnetizable particles have a diameter in the range of about 1–100 μm.

4. The formulation of claim 3, wherein the magnetizable particles have a bimodal size distribution, with a first group of particles having a mean diameter greater than 7 μm and a second group of particles having a mean diameter less than 3 μm.

5. The formulation of claim 1, wherein the liquid vehicle is selected from the group consisting of: water, hydrocarbon oils, mineral oils, esters of fatty acids, polydimethylsiloxanes, polyalphaolefin, dioctyl sebacate and silicone liquids.

6. The formulation of claim 1, wherein the surfactant is an ethoxylated tallow alkyl amine, an ethoxylated coco alkyl amine, an ethoxylated oleyl amine, an ethoxylated soya alkyl amine, an ethoxylated octadecyl amine or an ethoxylated diamine.

7. The formulation of claim 1, wherein the fumed silica has a surface area of about 275–410 $m^2/g$.

8. The formulation of claim 1, wherein the fumed silica has a surface area in the range of 275–325 $m^2/g$.

9. The formulation of claim 1, wherein the fumed silica has a surface area in the range of 300–350 $m^2/g$.

10. The formulation of claim 1, wherein the fumed silica has a surface area in the range of 350–410 $m^2/g$.

11. The formulation of claim 1, wherein the fumed silica is present in an amount ranging from about 0.1 to about 5.0 percent by weight relative to the total weight of the magnetorheological fluid.

12. A magnetorheological fluid formulation comprising magnetizable particles dispersed in a mixture of a liquid vehicle, a surfactant and a thixotropic agent, wherein the thixotropic agent is untreated fumed silica present in an amount of about 0.1 to about 5.0 percent by weight relative to the total weight of the fluid formulation and the silica has a surface area of about 275–410 $m^2/g$, and wherein the surfactant is present in the formulation in an amount of about 10–30% by weight relative to the weight of the fumed silica.

13. The formulation of claim 12, wherein the magnetizable particles are selected from the group consisting of iron, nickel, cobalt and magnetic alloys thereof.

14. The formulation of claim 13, wherein the magnetizable particles have a diameter in the range of about 1–100 μm.

15. The formulation of claim 14, wherein the magnetizable particles have a bimodal size distribution, with a first group having a mean diameter greater than 7 μm and a second group of particles having a mean diameter less than 3 μm.

16. The formulation of claim 12, wherein the liquid vehicle is selected from the group consisting of: water, hydrocarbon oils, mineral oils, esters of fatty acids, polydimethylsiloxanes, polyalphaolefins, dioctyl sebacate and silicone liquids.

17. The formulation of claim 12, wherein the surfactant is an ethoxylated tallow alkyl amine, an ethoxylated coco alkyl amine, an ethoxylated oleyl amine, an ethoxylated soya alkyl amine, an ethoxylated octadecyl amine or an ethoxylated diamine.

18. The formulation of claim 12, wherein the fumed silica has a surface area in the range of 275–325 $m^2$ /g.

19. The formulation of claim 12, wherein the fumed silica has a surface area in the range of 300–350 $m^2/g$.

20. The formulation of claim 12, wherein the fumed silica has a surface area in the range of 350–410 $m^2/g$.

21. A method of formulating a magnetorheological fluid comprising:

mixing a liquid vehicle and an untreated fumed silica under high shear, the silica having a surface area of at least about 250 $m^2/g$;

adding a surfactant to the mixture of the liquid vehicle and fumed silica in an amount between about 10% and about 30% by weight relative to the weight of the fumed silica; and dispersing magnetizable particles in the mixture to form a suspension.

22. The method of claim 21, wherein the fumed silica is present in an amount ranging from about 0.1 to about 50 percent by weight relative to the overall weight of the magnetorheological fluid.

23. The method of claim 21, wherein the surfactant is added to the mixture by coating the magnetizable particles with the surfactant prior to dispersing the particles in the mixture.

24. The method of claim 21, wherein the magnetizable particles are selected from the group consisting of iron, nickel, cobalt and magnetic alloys thereof.

25. The method of claim 24, wherein the magnetizable particles have a diameter in the range of about 1–100 μm.

26. The method of claim 25, wherein the magnetizable particles have a bimodal size distribution, with a first group of particles having a mean diameter greater than 7 μm and a second group of particles having a mean diameter less than 3 μm.

27. The method of claim 21, wherein the liquid vehicle is selected from the group consisting of: water, hydrocarbon oils, mineral oils, esters of fatty acids, polydimethylsiloxanes, polyalphaolefins, dioctyl sebacate and silicone liquids.

28. The method of claim 21, wherein the surfactant is an ethoxylated tallow alkyl amine, an ethoxylated coco alkyl amine, an ethoxylated oleyl amine, an ethoxylated soya alkyl amine, an ethoxylated octadecyl amine or an ethoxylated diamine.

29. The method of claim 21, wherein the fumed silica has a surface area of about 275–410 $m^2/g$.

30. The method of claim 21, wherein the fumed silica has a surface area in the range of 275–325 $m^2/g$.

31. The method of claim 21, wherein the fumed silica has a surface area in the range of 300–350 $m^2/g$.

32. The method of claim 21, wherein the fumed silica has a surface area in the range of 350–410 $m^2/g$.

* * * * *